US010865038B2

(12) United States Patent
Huhtasalo

(10) Patent No.: US 10,865,038 B2
(45) Date of Patent: Dec. 15, 2020

(54) CIGARETTE PACK COMPRISING AN RFID/NFC TAG

(71) Applicant: Stora Enso OYJ, Helsinki (FI)

(72) Inventor: Lauri Huhtasalo, Tampere (FI)

(73) Assignee: STORA ENSO OYJ, Helsinki (FI)

( * ) Notice: Subject to any disclaimer, the term of this patent is extended or adjusted under 35 U.S.C. 154(b) by 0 days.

(21) Appl. No.: 16/478,384

(22) PCT Filed: Feb. 14, 2018

(86) PCT No.: PCT/IB2018/050892
§ 371 (c)(1),
(2) Date: Jul. 16, 2019

(87) PCT Pub. No.: WO2018/150331
PCT Pub. Date: Aug. 23, 2018

(65) Prior Publication Data

US 2019/0367257 A1 Dec. 5, 2019

(30) Foreign Application Priority Data

Feb. 16, 2017 (SE) ..... 1750149

(51) Int. Cl.
*B65D 85/10* (2006.01)

(52) U.S. Cl.
CPC ..... *B65D 85/1045* (2013.01); *B65D 2203/10* (2013.01)

(58) Field of Classification Search
CPC ..... B65D 85/1045; B65D 85/1036; B65D 2203/10; A24F 15/005
(Continued)

(56) References Cited

U.S. PATENT DOCUMENTS 7,106,202 B2 * 9/2006 Dickinson ..... B65D 5/4233 206/459.5
2004/0149602 A1 * 8/2004 Draghetti ..... B65D 85/1072 206/262
(Continued)

FOREIGN PATENT DOCUMENTS

CN 201249952 Y 6/2009
CN 204355406 U 5/2015
(Continued)

OTHER PUBLICATIONS

Wimmer, Martin, International Search Report for Application No. PCT/IB2018/050892, dated Apr. 25, 2018.

*Primary Examiner* — Luan K Bui
(74) *Attorney, Agent, or Firm* — Greer, Burns & Crain, Ltd.

(57) ABSTRACT

A cigarette pack (1) comprising a box body (2); an inner wrapper (15), comprising an aluminium layer, is arranged on the inside of the box body (2); a lid (8) connected to the box body by a hinge (9) and capable of opening and closing the upper end of the box body, the lid having an open lower end (10), front wall (11), a rear wall (12), a pair if side walls (18) and a top wall (13, 14) having an outside (13) and an inside (14), which inside (14) faces against the open upper end (3) and the inner wrapper (15) when the lid is in a closed position; an RFID/NFC tag (16) and a distance layer (20), which is arranged on the inside and that the RFID/NFC tag is arranged on the distance layer. The distance layer forces the RFID/NFC tag close to the wrapping material.

9 Claims, 1 Drawing Sheet

(58) Field of Classification Search
USPC ..... 206/242, 247, 265, 268, 271, 273; 229/87.14, 160.1
See application file for complete search history.

(56) References Cited

U.S. PATENT DOCUMENTS

| | | | | |
|---|---|---|---|---|
| 2005/0224374 | A1* | 10/2005 | Petrucci | B65D 85/1072 206/242 |
| 2011/0050426 | A1 | 3/2011 | Choong | |
| 2016/0000144 | A1* | 1/2016 | Bigelow | A24F 23/00 206/268 |
| 2016/0107796 | A1* | 4/2016 | Sibley | B65D 25/205 206/213.1 |
| 2020/0223618 | A1* | 7/2020 | Cailleaux | B65D 85/1045 |

FOREIGN PATENT DOCUMENTS

| | | | |
|---|---|---|---|
| CN | 106043902 | A | 10/2016 |
| CN | 206172081 | U | 5/2017 |

* cited by examiner

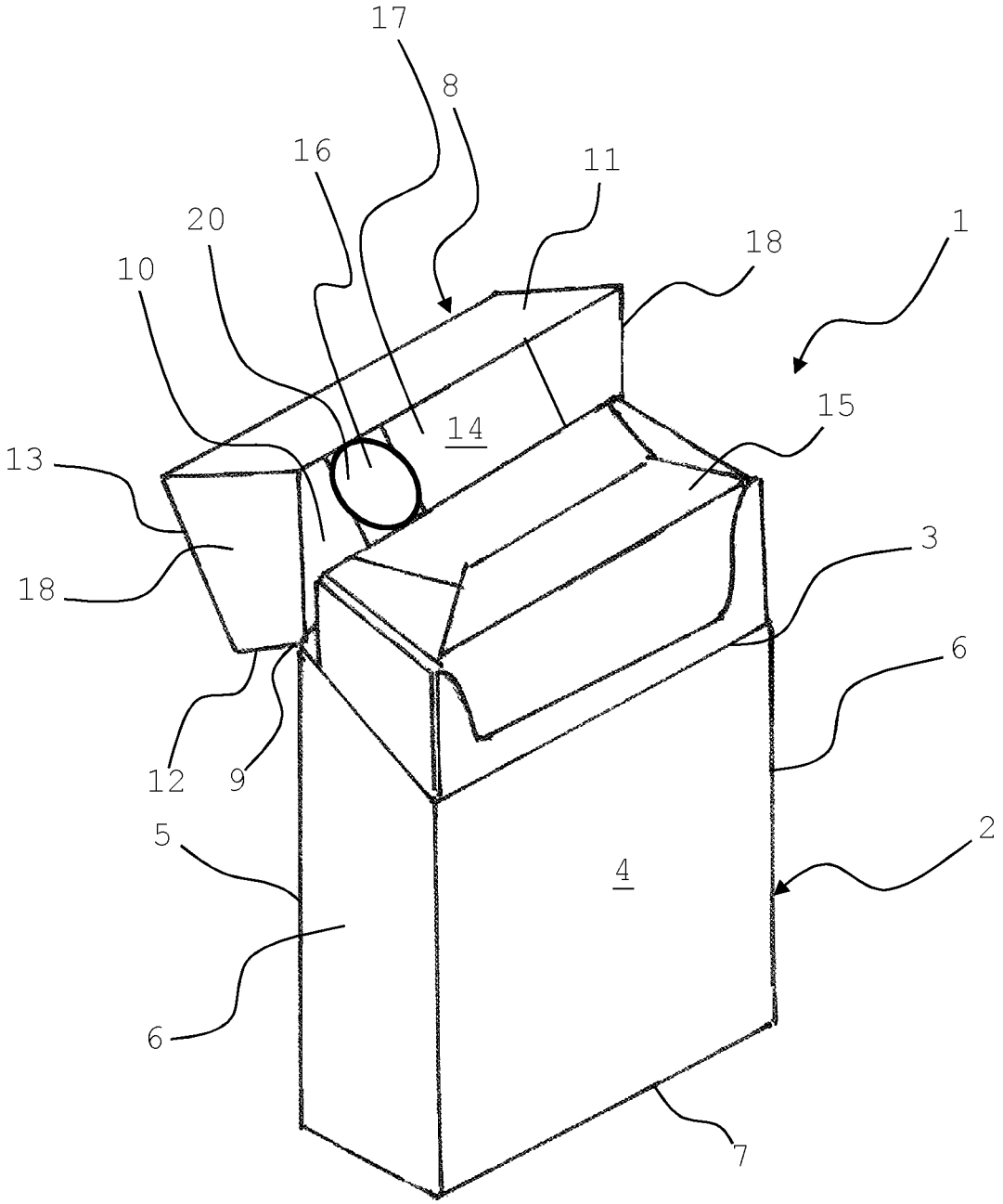
17
8
16
11
20
18
1
10
15
14
13
3
18
6
12
9
5
2
4
6
7

CIGARETTE PACK COMPRISING AN RFID/NFC TAG

This application is a U.S. National Phase under 35 U.S.C. § 371 of International Application No. PCT/IB2018/050892, filed Feb. 14, 2018, which claims priority under 35 U.S.C. §§ 119 and 365 to Swedish Application No. 1750149-5, filed Feb. 16, 2017.

TECHNICAL FIELD

The present invention relates to a cigarette pack comprising:

a box body having an open upper end, a front wall, a rear wall, a pair of side walls and a bottom wall;

an inner wrapper, comprising an aluminium layer, is arranged on the inside of the box body, suitable for wrapping around a bundle of cigarettes;

a lid connected to the box body by a hinge and capable of opening and closing the upper end of the box body, the lid having an open lower end, a front wall, a rear wall, a pair if side walls and a top wall having an outside and an inside, which inside faces against the open upper end and the inner wrapper when the lid is in a closed position; and an RFID/NFC tag.

In the following the term RFID/NFC tag will be frequently used. In this context, this term concerns either an NFC (Near Field Communication) tag or and RFID (Radio Frequency Identification) tag.

Background—Problem

There is a global trend that it is, or will be, forbidden for tobacco producers to have printed marketing and branded content on their cigarette packages. This is, of course, a problem for producers and marketers, since brand images is a highly important aspect in the tobacco business. A way to solve this issue, is to equip the cigarette package with a RFID/NFC tag. An RFID/NFC tag can engage with the costumer via an NFC equipped device, such as e.g. a smartphone.

However, a technical problem with this is that many cigarette packs use a paper with an aluminum layer as a protecting inner material. This inner material is used to wrap the cigarettes and protect the cigarettes from moisture, heat, cold and other external impacts. The aluminum layer will prevent RFID/NFC tags from functioning properly, as such tags normally don't function well if they are attached close or onto a metal substrate.

A typical solution to such problem is to add an additional ferrite layer to the RFID/NFC construction, as a layer between the transponder antenna conductor and the aluminum layer. Such solutions are widely available and known. However, such a solution has some problems if it is applied onto a cigarette pack. To start with, ferrite is an expensive material and a low cost item, such as a cigarette pack, cannot justify use of such an expensive material. Moreover, in order to function properly, the ferrite layer must be relative thick, which also makes the tag relative thick. Finally, the thick RFID/NFC tag on the side wall of the cigarette pack might cause jamming in the cigarette packing process.

Furthermore, some countries have banned advertising of cigarettes to people under a certain age-limit. A problem with RFID/NFC tag advertising is that consumers under legal age can freely enter the store and might interact with the cigarette pack marketing content. Therefore, it would beneficial with a tagging solution where the cigarette pack marketing content is not readable until after purchase in the store.

Object of Invention

An object with the present invention is to present a cigarette pack which solve the above mentioned problems with RFID/NFC tags in cigarette packages.

SUMMARY OF THE INVENTION

The cigarette pack, in accordance with the invention, is characterized in that the cigarette pack further comprising a distance layer, which is arranged on the inside of the top wall and that the RFID/NFC tag is arranged on the distance layer, such that the distance layer forces the RFID/NFC tag close to the wrapping material in the closed position.

DETAILED DESCRIPTION OF THE INVENTION

In the following the invention will be described more in detail with reference to FIG. 1.

FIG. 1 discloses a cigarette pack 1 in accordance with the invention. The cigarette pack 1 comprising a box body 2 having an open upper end 3, a front wall 4, a rear wall 5, a pair of side walls 6 and a bottom wall 7.

The cigarette pack 1 further comprising an inner wrapper 15, with an aluminium layer, which inner wrapper 15 is arranged on the inside of the box body, suitable for wrapping around a bundle of cigarettes.

Moreover, the cigarette pack comprising a lid 8. The lid 8 is connected to the box body 2 by a hinge 9 and capable of opening and closing the upper end 3 of the box body 2. The lid 8 having an open lower end 10, a front wall 11, a rear wall 12, a pair of side walls 18 and a top wall 13, 14. The top wall having an outside 13 and an inside 14, which inside 14 faces against the upper end 3 and the top part of the inner wrapping 15, when the cigarette box is in a closed position. The rear wall 12 of the lid 8 is connected to the rear wall 5 of the cigarette box 2 via the hinge 9.

FIG. 1 discloses the lid in an open position. When the lid is in a closed position the inside 14 facing against the top of the inner wrapping 15.

The cigarette pack 1 further comprising an RFID/NFC tag 16. The RFID/NFC tag 16 is arranged on the inside 14 of the top wall 13, 14. The RFID/NFC tag 16 is arranged to enable interacting with an NFC equipped device, e.g. a smartphone. When the lid is closed the RFID/NFC tag 16 is facing against the upper part or top of the inner wrapping 15.

In accordance with the invention, a thick distance layer 20 is arranged between the inside 14 of the lid and the RFID/NFC tag, such that, the RFID/NFC transponder coil is pressed against, or very close, to the top of the inner wrapping 15. This secures that the RFID/NFC tag will not function properly, in closed position, as the close proximity of the aluminium foil will prevent its functionality. The distance layer 20 has preferably a thickness of about 1-5 mm. The distance layer 20 may be any material that do not interfere with the RFID/NFC antenna. A suitable distance layer material is plastic or fibre based material. A preferred layer material is corrugated board or paper board.

When the cigarette pack is closed, i.e. the RFID/NFC tag is facing against the upper part of the inner wrapping, the antenna will be interfered by the aluminium in the inner wrapping. Hence, the antenna will not work properly when the cigarette pack is closed, i.e. the lid is in a closed position. This means that it will not be able to engage with a person via an NFC equipped device, such as e.g. a smartphone, when the cigarette pack is located in a store for purchase.

However, after the cigarette pack has been opened, i.e. the lid is an opened position as in FIG. 1, the antenna will no longer be in contact with the aluminium layer and the customer can engage to the NFC/RFID tag via an NFC equipped device. This means that it will not be possible for people under the age limit for buying cigarettes to engage with the material on the RFID/NFC tag as long as the cigarette pack is closed in the store. Hence, the material on the RFID/NFC tag will only be available after purchase.

A major benefit with the present invention is that the position of the RFID/NFC tag in the lid won't cause any jamming in the cigarette packing process.

In the foregoing, the invention has been described on the basis of some specific embodiments. It is appreciated, however, that other embodiments and variants are possible within the scope of the following claims.

The invention claimed is:

1. A cigarette pack comprising:

a box body having an open upper end, a front wall, a rear wall, a pair of side walls and a bottom wall;

an inner wrapper, comprising an aluminum layer, is arranged on the inside of the box body, suitable for wrapping around a bundle of cigarettes;

a lid connected to the box body by a hinge and capable of opening and closing the upper end of the box body, the lid having an open lower end, a front wall, a rear wall, a pair of side walls and a top wall having an outside and an inside, which inside faces against the open upper end and the inner wrapper when the lid is in a closed position;

an RFID/NFC tag; and a distance layer, which is arranged on the inside of the top wall and that the RFID/NFC tag is arranged on the distance layer, such that the distance layer forces the RFID/NFC tag close to the wrapping material in the closed position.

2. A cigarette pack according to claim 1, wherein the distance layer is made of a material that does not interfere with an antenna of the RFID/NFC tag.

3. A cigarette pack according to claim 1, wherein the distance layer is made paper board or corrugated board.

4. A cigarette pack according to claim 1, wherein the distance layer has a thickness of at least 1 mm.

5. A cigarette pack according to claim 1, wherein the distance layer has a thickness in the range 1-5 mm.

6. A cigarette pack according to claim 1, wherein an antenna of the RFID/NFC tag is interfered by the aluminum layer, when the lid is in a closed position.

7. A cigarette pack according to claim 1, wherein the RFID/NFC tag cannot engage with an NFC equipped device in the closed position.

8. A cigarette pack according to claim 1, wherein an antenna of the RFID/NFC tag is not interfered by the aluminum layer, when the lid is in an opened position.

9. A cigarette pack according to claim 1, wherein the RFID/NFC tag is able to engage with an NFC equipped device in the opened position.

* * * * *